United States Patent [19]

Pomber

[11] 4,336,737

[45] Jun. 29, 1982

[54] RELAY VALVE ASSEMBLY FOR PLAYER PIANOS

[75] Inventor: Harry A. Pomber, Sault Ste. Marie, Canada

[73] Assignee: Sounds Alive Systems, Inc., Houghton Lake, Mich.

[21] Appl. No.: 142,088

[22] Filed: Apr. 21, 1980

[51] Int. Cl.[3] ..... G10F 5/04

[52] U.S. Cl. ..... 84/151; 84/115

[58] Field of Search ..... 84/115, 147, 151, 160, 84/88, 148–150, 156

[56] References Cited

U.S. PATENT DOCUMENTS

| | | | |
|---|---|---|---|
| 370,466 | 9/1887 | Gally | 84/156 |
| 780,862 | 1/1905 | Cameron | 84/160 |
| 1,224,783 | 5/1917 | Pilcher | 84/88 |
| 2,801,563 | 8/1957 | Koehl | 84/147 X |

*Primary Examiner*—Lawrence R. Franklin

*Attorney, Agent, or Firm*—Michael L. Bauchan

[57] ABSTRACT

This apparatus pertains to mechanical and electromagnetic apparatus for controlling player piano operation. The conventional player piano paper tape which opens and closes pneumatic holes in a tracker bar is replaced by a valve board and a plurality of electromagnetic valves. Each electromagnetic valve operates to control air passage through one of the holes in the tracker bar.

3 Claims, 4 Drawing Figures

RELAY VALVE ASSEMBLY FOR PLAYER PIANOS

BACKGROUND OF THE INVENTION

Player pianos have been in common usage for many years. While player pianos differ in their general configuration, they usually function in substantially the same manner.

A typical player piano has a keyboard containing 88 keys similar to the keys of most other pianos. Above the keyboard of most player pianos is a mechanism which provides for the automatic operation of the piano. This mechanism in most player pianos employs a tracker bar in which is situated an array of pneumatic holes. Each hole corresponds to a single key of the keyboard.

The typical player piano control apparatus also includes two spindles which cooperate to hold the ends of a scroll so the center of the scroll is stretched tightly across the tracker bar. The scroll, which is often called a tape, is usually made of paper.

The typical player piano utilizes a source of power and interior mechanical parts which wind the scroll from one spindle to the other across the tracker bar at a predetermined speed and which also include a pneumatic system that applies suction to each tracker bar hole on the side opposite the paper scroll. The pneumatic system detects a pressure differential in the tracker bar holes to operate the piano keyboard action in a predetermined manner.

The player piano action is controlled by putting openings of predetermined size and length in the paper scroll so the openings cross the tracker bar holes in a predetermined manner.

When a paper scroll hole is aligned with a tracker bar hole the corresponding pneumatic system detects normal atmospheric pressure in the tracker bar hole. When a solid portion of the paper scroll covers a tracker bar hole, it prevents the passage of air through the tracker bar hole and the pneumatic mechanism therefore senses a different air pressure in the tracker bar hole than the level of air pressure existing therein when a hole in the paper scroll permits ambient air pressure surrounding the piano to communicate with the tracker bar hole.

Since the paper scroll more effectively seals the tracker bar hole when pressure in the tracker bar hole is less than the air pressure in the room around the piano, the pneumatic mechanism usually operates by applying suction to the tracker bar hole.

The aforedescribed paper scroll and player piano mechanics in operation are attractive in a nostalgic sense, but have certain inherent disadvantages. For example, the paper scroll can easily be torn or damaged. The paper scroll is also relatively bulky. The scroll drive mechanism requires maintenance, and the paper roll may tear.

It is therefore an object of this invention to replace the paper scroll by a valve board unit controlled by electric pulses which opens and closes the tracker bar holes in accordance with predetermined electric signals.

It is a further object of this invention to provide a valve board to replace a player piano paper scroll which connects directly to the face of a player piano tracker bar so as to open and close tracker bar holes at the same point they would be opened and closed by a paper scroll.

It is a further object of this invention to provide a valve board which can be premanently mounted on a player piano so as to control the player piano pneumatics while permitting conventional player piano operation controlled by a paper scroll.

SUMMARY OF THE INVENTION

This invention is of a unique player piano valve board which controls operation of player piano pneumatics in response to electric signals. The valve board may be connected to a player piano so as to open and close the holes in the player piano tracker bar at the point where they are normally opened and closed by a paper scroll. In the alternative, the valve board may be connected to the player piano pneumatics on the side of the tracker bar opposite the paper scroll so as to permit operation of the player piano pneumatics in accordance with the paper scroll perforations or in accordance with the electric signals.

DISCUSSION OF THE DRAWINGS

This invention will be better understood from the following description in conjunction with the accompanying drawings, in which.

DESCRIPTION OF THE PREFERRED EMBODIMENT

Figure 1:
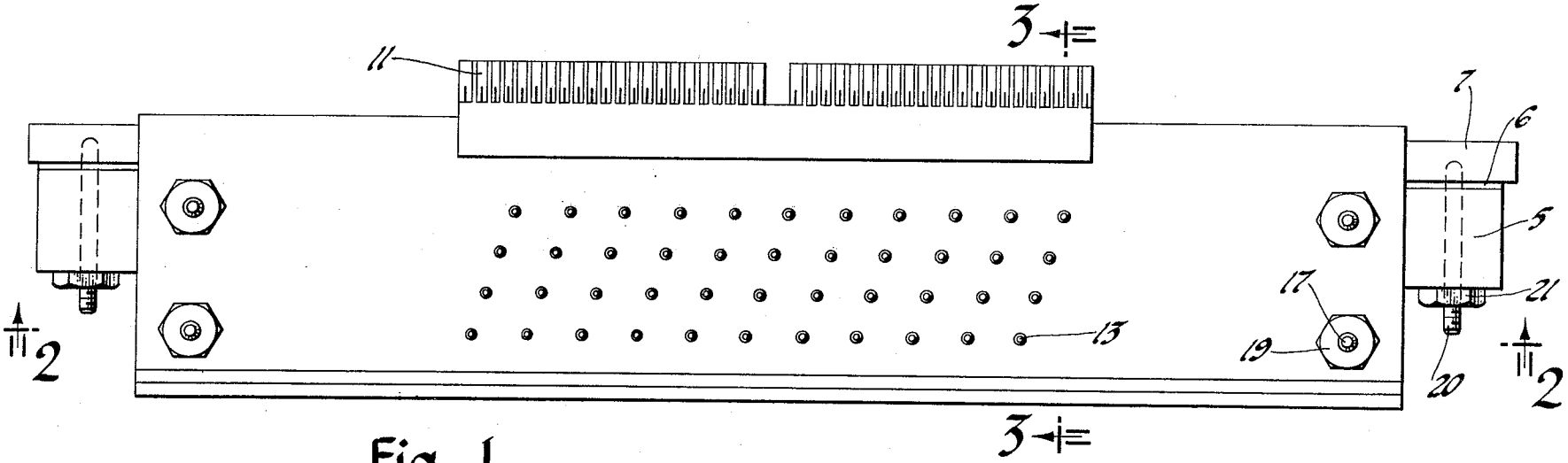
FIG. 1 is a top view of a valve board incorporating the principles of this invention.

As shown in the drawings, a player piano tracker bar 7, which is commonly made of brass, has a plurality of holes 30 extending through it from a curved surface 32 which is an exterior surface of the piano to a straight surface 34 which connects to the interior piano pneumatics which are not illustrated in the drawings. The player piano paper scroll is stretched across the curved surface 32 of the tracker bar 7.

Figure 3:
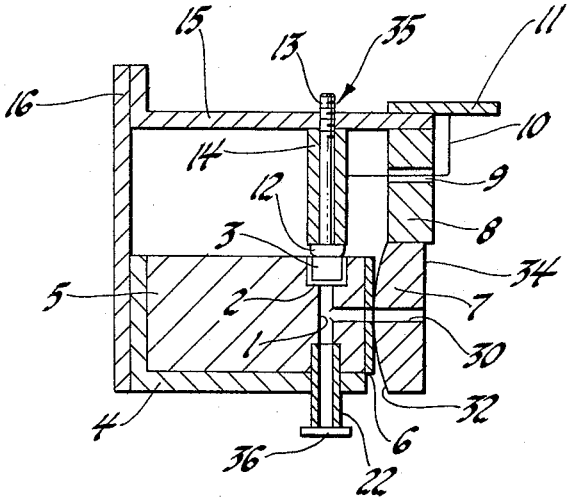
FIG. 3 is a side elevation view of FIG. 2 on lines B—B.

As shown in FIG. 3, each hole 30 in the tracker bar 7 communicates with a hole 1 in a valve board 5 through a gasket 6. As persons versed in the art will appreciate, the material of each of the various components may be made of many different substances without detracting from the spirit of the invention. Nevertheless, in practice it has been found that the valve board 5 may be made of a plastic casting and the gasket 6 may be made of a piece of paper having a plurality of holes therein to permit each of the holes 30 in the tracker bar 7 communicating with a corresponding hole 1 in the valve board 5.

In the illustrated embodiment, the valve board 5 is reinforced by a reinforcing member 4 which may be of an aluminum extrusion or angle material.

The hole 1 in the illustrated embodiment is in the form of a "T" as illustrated in FIG. 3 to facilitate connection of the valve board 5 to the tracker bar 7 hole 30 in the alternative manner which will be described later in this Specification.

In the embodiment illustrated in FIG. 3, the hole 1 communicates with a tube 22 that extends from the bottom of the valve board 5. In the embodiment illustrated in FIG. 3, all of the tubes 22 are simply plugged, such as by placing a piece of tape 36 over the ends of the tubes 22.

Above the hole 1 in the valve board 5 is a valve seat 2 formed in the valve board 5. The valve seat 2 is an enlarged portion of the hole 1 and contains a valve 3. The valve 3 is a free floating valve made of mild steel in the preferred embodiment and is a cylindrical disc. It may be provided with a leather face on the surface abutting the valve seat 2 so as to provide an air tight seal of the hole 1. The valve 3 is normally held by gravity on the hole 1.

Above the valve 3 is a core head 12 which in the preferred embodiment is also made of mild steel and is an enlarged portion of a core 13 that is also made of mild steel and threaded at the top end into a frame board 15 that in the preferred embodiment is made of aluminum. The core 13 is surrounded by a relay coil 14 which is comprised of a wire 10 wound many times around the core 13 and held in position at the lower end by the core head 12. The wire 10 may be of any suitable size so long as it cooperates with the core 13 to form an electromagnet as the core 13, the coil 14, the core head 12, and the valve 3 together form an electromagnetic valve 35. In practice, it has been found that the wire 10 may be made of 36 gauge wire capable of conducting a current of approximately 65 milliamps.

One end of the wire 10 is electrically connected to the core 13, which may be accomplished by a solder joint. Since the core 13 is threaded into the aluminum frame board 15, all of the cores 13 have a common electric connection.

The other end of the wire 10 passes through a guide hole 9 in a wooden guide hole bar 8 to one terminal of a connector board 11. As shown in FIG. 1, each of the wires 10 is connected to a discrete terminal on the connector board 11. The connector board 11 may be of a suitable insulating material on which each terminal is a discrete electric conductor. The connector board 11 connects to a corresponding connector board on the player piano.

As shown in FIG. 3, the frame board 15 is supported above the valve board 5 by a frame board support 16 which in the preferred embodiment is made of aluminum and securely fastened to both the reinforcing member 4 and the frame board 15.

Figure 2:
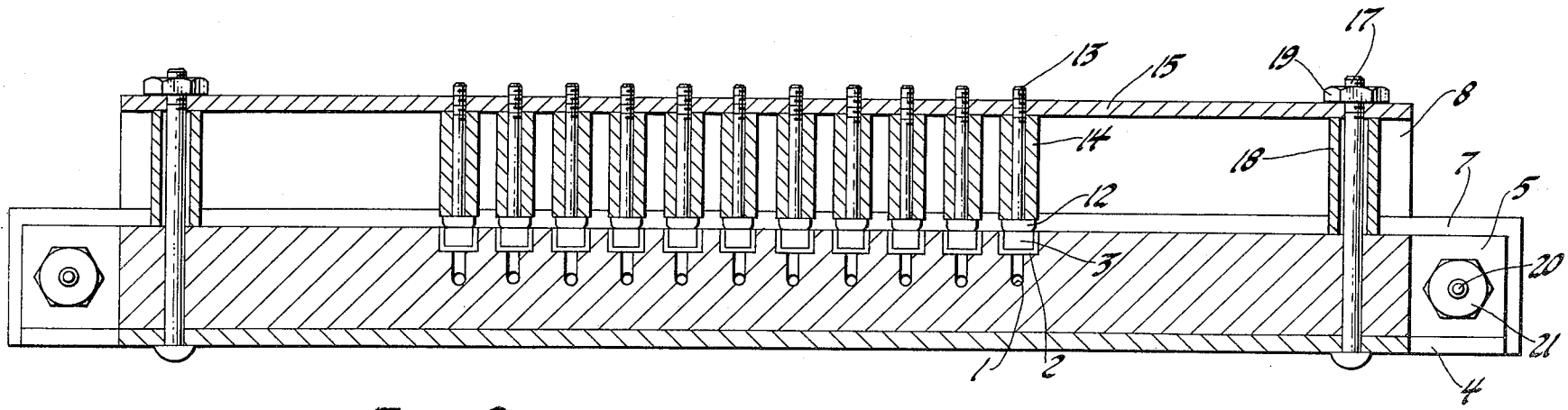
FIG. 2 is a front elevation of the valve board in FIG. 1 taken along the lines A—A.

As shown in FIGS. 1 and 2, the frame board 15 is securely fastened to the reinforcing member 4 and other components by a bolt 17 which extends through a cylindrical sleeve 18 which acts as a spacer between the frame board 15 and the valve board 5 and is connected by means of a nut 19.

As is also shown in FIGS. 1 and 2 in the illustrated embodiment, the tracker bar 7 is securely fastened to the valve board 5 by means of bolts 20 and nuts 21 which connect them in a conventional manner.

The relay valve assembly for player pianos in the illustrated embodiment is so positioned that each of the valve board holes 1 communicate with one of the holes 30 in the tracker bar 7. Suction is applied to the holes 30 in the tracker bar 7 from inside the player piano in a conventional manner by apparatus not shown in the drawings. The paper gasket 6 seals the connection to the valve board 5. Tape 36 on the end of the tube 22 prevents normal atmospheric pressure from causing air to enter the valve board hole 1. The weight of the valve 3 is forced by gravity against the hole 1. Therefore, suction in the player piano pneumatic mechanism gets the same signal normally as if a paper scroll blocks the hole 30 to the tracker bar 7.

However, when an electric pulse is applied to the terminal in the connector board 11 to which the wire 10 is connected, the relay coil 14 is energized, which generates a magnetic force on the valve 3 sufficient to overcome suction in the valve board hole 1 and to overcome weight of the valve 3. The valve 3 is then lifted until it abuts the core head 12 in the position illustrated in FIG. 3. Air in the atmosphere around the piano is then permitted to pass through the guide hole 9 in the guide hole bar 8 around the wire 10. Atmospheric air also goes past the valve 3 into the valve board hole 1, which communicates with the hole 30 in the tracker bar 7 through the gasket 6.

It is thus apparent that when an electric pulse is applied to a terminal in the connector board 11, the corresponding hole 30 in the tracker bar 7 communicates with the atmosphere and pneumatic pressure in the hole 30 in the tracker bar 7 is increased. The pulse applied to the terminal on the connector board 11 thus has the same effect on the pneumatic mechanism in the player piano as is caused by a hole in a paper scroll on curved surface 32 being aligned with the hole 30 in the tracker bar 7.

Figure 4:
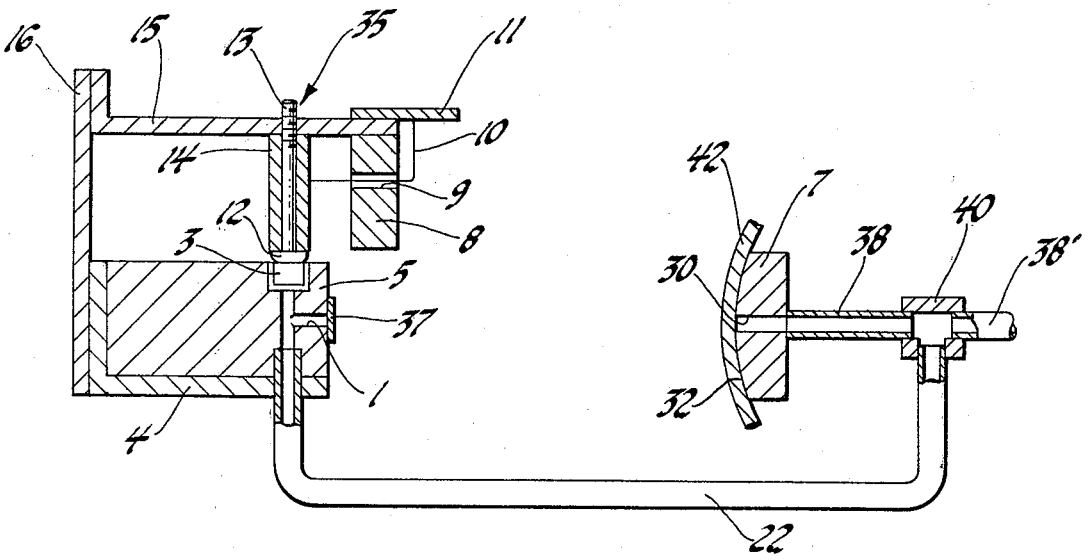
FIG. 4 is an alternative connection of FIG. 3.

It is apparent that when the subject relay valve assembly for player pianos is bolted to the curved surface 32 of the tracker bar 7 the player piano to which it is attached cannot easily be operated by means of a paper tape. However, the subject apparatus is designed as briefly mentioned previously to permit operation of the player piano in the usual manner according to movement of a paper scroll. This operation is illustrated in FIG. 4 and accomplished by positioning the aforedescribed apparatus at a point away from the tracker bar 7. All player piano scrolls have beginning and ending sections which do not contain any perforations. By placing a paper scroll 42 across the curved surface 32 of the tracker bar 7 at the beginning or end of the scroll 42, the surface of the scroll 42 will plug all of the holes 30 in the tracker bar 7. In the alternative, a simple piece of tape could be stretched across all of the holes 30 in the tracker bar 7 and a second piece of tape 37 is placed across holes 1 in the valve board 5 adjacent the gasket 6.

As persons versed in the art will appreciate, the straight surface 34 of the tracker bar 7 through which the hole 30 in the tracker bar 7 extends is connected through a conventional pneumatic tube 38 to the pneumatic mechanism which operates the player piano. Persons versed in the art will appreciate that the pneumatic tube 38 can easily be cut and a "T" connection 40 be inserted in the tube 38.

The suction tube 22 on the bottom of the valve board 5 in FIG. 4 is extended for connection to the "T" connection 40 in the pneumatic tube 38 on the back of the tracker bar 7.

As persons versed in the art will appreciate, when the holes in the tracker bar 7 are covered by a paper scroll 42 or a piece of tape and each of the suction tubes 22 is connected to the corresponding hole 30 through tube 38 of the tracker bar 7, the suction in the hole of the tracker bar 7 is applied through the suction tube 22. Accordingly, when the terminal on the connector board 11 receives an electric pulse as aforedescribed, the valve 3 is lifted from the valve seat 2 and atmospheric pressure communicates through the hole 1 and the suction tube 22 to the pneumatic mechanism in the player piano. The operation of the apparatus in this embodiment is thus identical with the operation previously described. All that is required is that either all of the holes 1 in the valve board 5 are prevented from communicating with the pneumatic mechanism of the player piano through the tracker bar 7 while the suction tubes 22 are connected to the pneumatic mechanism through tubes 38 or in the alternative the suction tubes 22 are each plugged by means of a piece of tape 36 and each of the holes 1 in the valve board 5 commlunicate through the tracker bar 7 with the pneumatic mechanism.

Persons versed in the art will appreciate that various modifications of the subject invention other than that illustrated are possible without departing from the spirit of the invention.

What is claimed is:

1. Apparatus for controlling operation of a player piano of the type that generally includes a vacuum source, a tracker bar having an array of holes positioned so as to extend through the tracker bar and be selectively exposed to the atmosphere as a perforated music sheet is passed across the tracker bar, and an array of pneumatic tubes which each connect the vacuum source to one of the tracker bar holes opposite the music sheet, comprising, in combination, an array of "T" connections each of which is inserted in one of said pneumatic tubes; a valve board; an array of holes which each have first and second openings in said valve board; a second array of pneumatic tubes which each connect one of said "T" connections to a first opening of one of said valve board holes; and an array of selectively operable electromagnetic valves which each selectively connect a second opening of one of said valve board holes to the atmosphere in response to an electric signal, each one of said valve board hole second openings including a valve seat and each one of said electromagnetic valves including a cylindrical free floating magnetic valve having a substantial height positioned so as to be held by gravity on one of said valve seats to prevent one of said valve board hole second openings connecting to the atmosphere and an electromagnet positioned above said cylindrical free floating magnetic valve so as to lift said free floating magnetic valve off said valve seat when said electromagnet is energized whereby said vacuum source may be selectively connected to the atmosphere (A) through said tracker bar holes in response to said music sheet or (B) through said valve board in response to said electric signals.

2. Apparatus for controlling a player piano that includes a tracker bar containing an array of holes which each may be selectively connected to the atmosphere through a perforated music sheet passing across a surface of the tracker bar and an array of pneumatic tubes connecting a vacuum source to the tracker bar holes opposite the music sheet comprising, in combination, a valve board; an array of holes in said valve board, each of said valve board holes being adaptable for connection through a first hole opening to which a pneumatic tube may be connected from said vacuum source, a second hole opening to the atmosphere and a third hole opening in a surface of said valve board which may be positioned proximate said tracker bar so as to permit said third opening to communicate with one of said tracker bar holes when said valve board surface is positioned proximate said tracker bar surface; an array of electromagnetic valves which each selectively open and close one of said valve board hole second openings to the atmosphere in response to an electric signal; and seal means for selectively sealing said tracker bar holes and said first or third openings in each of said valve board holes whereby (A) said player piano may be controlled by a music sheet when said valve board surface is not proximate said tracker bar surface and said valve board hole openings do not connect said vacuum source to the atmosphere or (B) said player piano may be controlled by selective energization of said eleectromagnetic valves either (1) when said valve board surface is proximate said tracker bar surface and said valve board hole first openings are sealed so as to selectively connect said vacuum source to the atmosphere through said tracker bar holes and said valve board second and third openings or (2) when said valve board surface is not proximate said tracker bar surface, said tracker bar holes are sealed, said valve board hole first openings are connected to said vacuum source by said pneumatic tubes and said valve board hole third openings are sealed so as to selectively connect said vacuum source to the atmosphere through said pneumatic tubes and said valve board hole first and second openings.

3. The apparatus of claim 2 in which said valve board hole second openings each includes a valve seat and said electromagnetic valves each include a free floating cylindrical magnetic valve that is held by gravity on said valve seat and an electromagnet above said free floating cylindrical magnetic valve whereby energization of said electromagnet lifts said free floating cylindrical magnetic valve off said valve seat and when said electromagnet is deenergized said free floating cylindrical magnetic valve is held by gravity on said valve seat.

* * * * *